US007938671B2

(12) United States Patent
Hayden, Sr.

(10) Patent No.: US 7,938,671 B2
(45) Date of Patent: May 10, 2011

(54) POWER CORD RETAINER

(75) Inventor: Perry L. Hayden, Sr., Salinas, CA (US)

(73) Assignee: Cisco Technology, Inc., San Jose, CA (US)

( * ) Notice: Subject to any disclaimer, the term of this patent is extended or adjusted under 35 U.S.C. 154(b) by 29 days.

(21) Appl. No.: 12/402,165

(22) Filed: Mar. 11, 2009

(65) Prior Publication Data

US 2010/0233898 A1 Sep. 16, 2010

(51) Int. Cl.
*H01R 13/62* (2006.01)

(52) U.S. Cl. ..... 439/371

(58) Field of Classification Search ..... 439/371, 439/373, 372, 345, 484, 144
See application file for complete search history.

(56) References Cited

U.S. PATENT DOCUMENTS

| | | | | |
|---|---|---|---|---|
| 4,204,738 | A * | 5/1980 | Tillotson | 439/369 |
| 4,702,709 | A * | 10/1987 | Santilli | 439/144 |
| 4,809,393 | A * | 3/1989 | Goodrich et al. | 15/323 |
| 5,655,924 | A * | 8/1997 | Cross et al. | 439/373 |
| 5,785,547 | A | 7/1998 | Cross et al. | |
| 6,012,940 | A | 1/2000 | Wheeler | |
| 6,192,558 | B1 * | 2/2001 | Badura | 24/599.1 |
| D467,492 | S | 12/2002 | Wieder | |
| 6,502,276 | B2 * | 1/2003 | Iversen | 15/323 |
| 6,712,637 | B2 | 3/2004 | Rosa et al. | |
| 6,767,237 | B1 * | 7/2004 | Shih | 439/371 |
| 6,896,537 | B2 | 5/2005 | Burton | |
| 6,948,963 | B2 | 9/2005 | Burton | |
| 6,957,977 | B1 | 10/2005 | Miller | |
| 7,004,785 | B2 | 2/2006 | Melton et al. | |
| 7,052,303 | B2 | 5/2006 | Burton | |
| 7,101,215 | B2 * | 9/2006 | Woellner et al. | 439/371 |
| 7,140,902 | B2 | 11/2006 | Burton | |
| 7,168,973 | B2 | 1/2007 | Wascow et al. | |
| 7,175,463 | B2 | 2/2007 | Burton | |
| 7,182,624 | B1 | 2/2007 | Miller | |
| 7,484,990 | B1 | 2/2009 | Lee et al. | |
| 7,722,380 | B1 * | 5/2010 | West et al. | 439/373 |
| 2010/0192330 | A1 * | 8/2010 | Walker | 24/129 R |

* cited by examiner

*Primary Examiner* — Chandrika Prasad
(74) *Attorney, Agent, or Firm* — Patent Capital Group

(57) ABSTRACT

An apparatus is provided in one example implementation and includes a body portion that includes a first member and a second member. The members taper at one end and are configured to be coupled to an electronic component at another end. The apparatus also includes a securing portion coupled to the body portion and configured to form a cavity through which a cord passes, the cord having a cord head that is fixed to the electronic component. A portion of a force exerted on the cord is transferred to the securing portion such that detachment of the cord head from the electronic component is inhibited. In more specific embodiments, the body portion and the securing portion are integrally formed as a single wire.

17 Claims, 3 Drawing Sheets

POWER CORD RETAINER

TECHNICAL FIELD OF THE INVENTION

The present invention relates generally to equipment and, more particularly, to power cord retainers.

BACKGROUND OF THE INVENTION

Electrical devices such as computer systems, gateways, and servers typically receive electrical power from a cord, which has a plug at one end. The plug is inserted into a socket or an outlet at a power source and the other end is coupled to the actual electrical device. In some applications, power is inadvertently interrupted by the cord being accidentally disconnected. This can be problematic for servers, gateways, and other devices tasked with the important responsibility of routing data in a network.

BRIEF DESCRIPTION OF THE DRAWINGS

In order to provide a better understanding, example embodiments are described in detail, by way of example only, with reference to the accompanying figures, in which.

DETAILED DESCRIPTION OF EXAMPLE EMBODIMENTS

Overview

An apparatus is provided in one example implementation and includes a body portion that includes a first member and a second member. The members taper at one end and are configured to be coupled to an electronic component at another end. The apparatus also includes a securing portion coupled to the body portion and configured to form a cavity through which a cord passes, the cord having a cord head that is fixed to the electronic component. A portion of a force exerted on the cord is transferred to the securing portion such that detachment of the cord head from the electronic component is inhibited. In more specific embodiments, the body portion and the securing portion are integrally formed as a single wire. The securing portion can define a space in the cavity such that the cord can be looped twice through the cavity. In still other embodiments, the securing portion can define the cavity such that once the cord is looped through the cavity, a biasing force is exerted on the cord. The body portion can include one or more fastening elements for coupling to the electronic component. The cavity can be C-shaped and meet the body portion as the first and second members taper.

Figure 1:
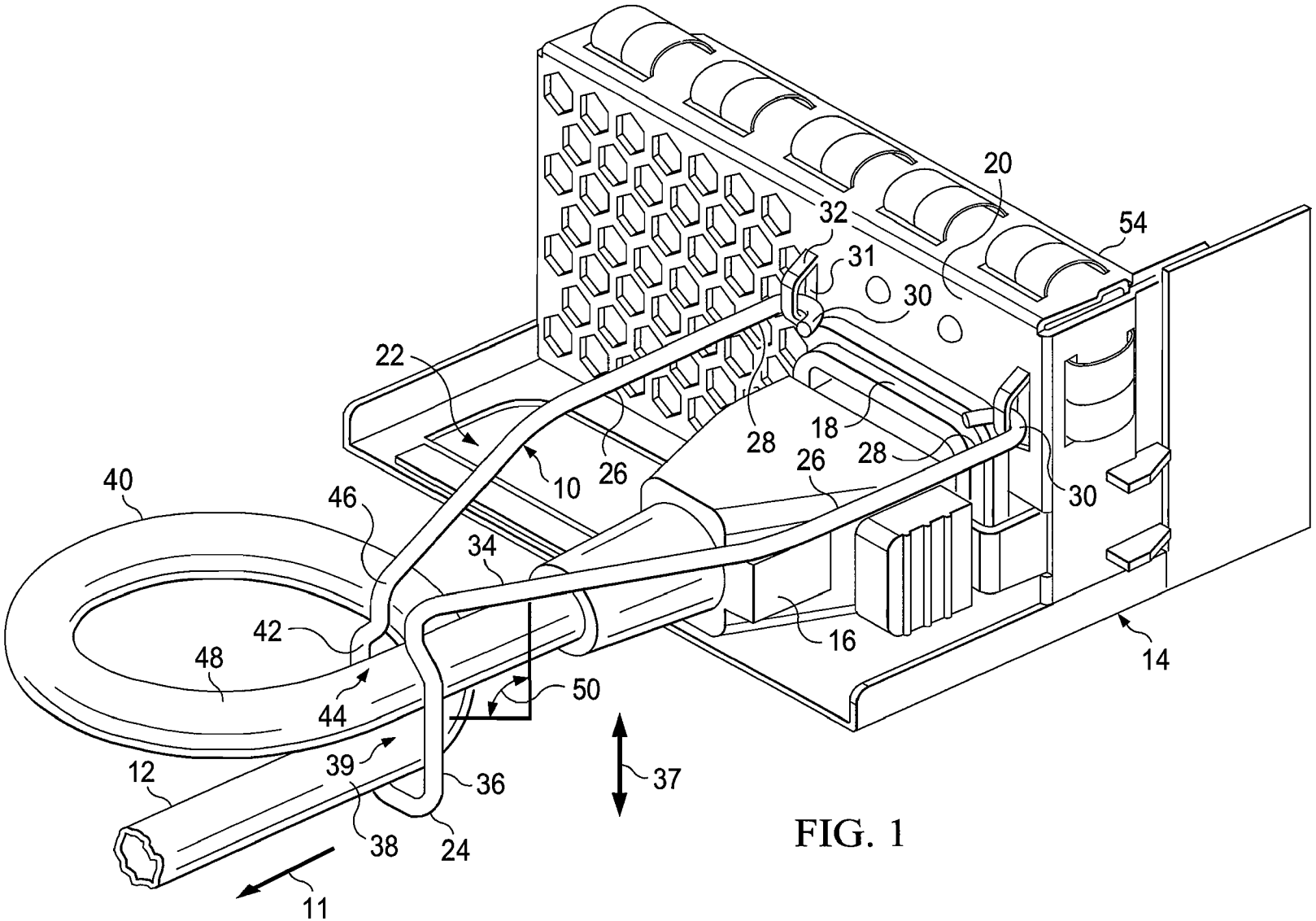
FIG. 1 is an example schematic diagram that provides a perspective view of a device for retaining a cord attached to an electronic component.

FIG. 1 is an example schematic diagram that provides a perspective view of a device 10 for retaining a cord 12 attached to an electronic component 14. One objective of device 10 may be to prevent cord 12 [attached to electronic component 14] from being inadvertently disconnected from electronic component 14. In this example, electronic component 14 is a network server, whose operation is sensitive to accidental power interruptions. Electronic component 14 can be various other types of electronic components (for both business [more robust] applications and consumer products) such as servers, personal computers, printers, high-definition televisions, sound systems, or any other electronic component or device. Typically, a continuous supply of power to a server is important for the continuity of network communications. The inadvertent unplugging of cord 12, for example, by a person tripping over cord 12 could lead to a significant loss of data, or a noticeable decline in unintentionally dropped connections. In contrast to these scenarios, any tensioning of cord 12 in a direction generally indicated by an arrow 11 would not disconnect cord 12 from electronic component 14, as device 10 would absorb this force, as detailed below.

Cord 12 can have a cord head 16 that could further include a coupling 18, which may be disposed on a back surface 20 of electronic component 14. This configuration is merely an example, which could be dictated or influenced by a manufacturer's individual design choices. In this embodiment, cord head 16 includes a plug and the coupling is a socket assembly mounted on back surface 20 of electronic component 14. The plug is obscured in this FIGURE, as it is located in the socket. The plug face can be fitted into the socket, where conventional friction would secure this connection. Note that, as used herein in this Specification, the term 'cord' includes any wire, cable, or electronic connection equipment that can be used in conjunction with device 10. Such applications may involve accidental power disruptions, but device 10 is not confined to power scenarios and, as such, can manage other cords that do not involve power issues. Device 10 can readily be used in other cord-management applications to help simplify or otherwise control how a cord moves in response to a retracting force being applied to the cord. In addition, it should be noted that as used herein in this Specification, the term 'retracting' is inclusive of any type of horizontal, lateral, or diagonal force (or any suitable combination of these forces) that applies a stress to the cord.

In this embodiment, device 10 is formed of a single length of resilient material (such as steel wire) forming a body that has been shaped so that it includes a plurality of bent sections 24. Any other suitable resilient material could be used, such as plastic, rubber, aluminum, titanium, or any other suitable alloy and/or any suitable combination of these elements. A body portion 22 of device 10 comprises two members 26, which are spaced apart. In this example, members 26 are spaced apart by slightly more than the width of the cord head. This permits the cord head to pass through the space between two members 26. The members could be spaced apart by some other dimension of the cord head, such as by cord head height, which would allow the cord head to be passed between them. Note that in other embodiments, the cord head itself could be retained in the cavity defined by securing portion 36. This implementation could further involve the cord head and then a loop of cord 12 being held together in the cavity. In such an example implementation, the cavity could have a uniform depth, or alternatively be provided with two tiers of depth (i.e., recesses) such that one tier would bias the cord head, while another tier biased the actual cord. Such a securing could similarly involve a sleeve of cord 12 or of the cord head (as illustrated in the FIGURES).

Members 26 terminate at a set of couplings 28 arranged to attach to electronic component 14. In this embodiment, the couplings have a set of hooks 30 formed thereon, which engage a set of apertures 31 defined by a set of receiving loops 32. The hook and loop arrangement allows device 10 to pivot around an axis connecting the loops. Some other pivoting mechanism (e.g., hinges) could readily be used. The pivot action allows the device to be swung away from coupling 18 for improved access thereto. The couplings may alternatively be arranged, for example, for the use of fasteners, such as screws, to secure device 10 to electronic component 14.

Figure 2:
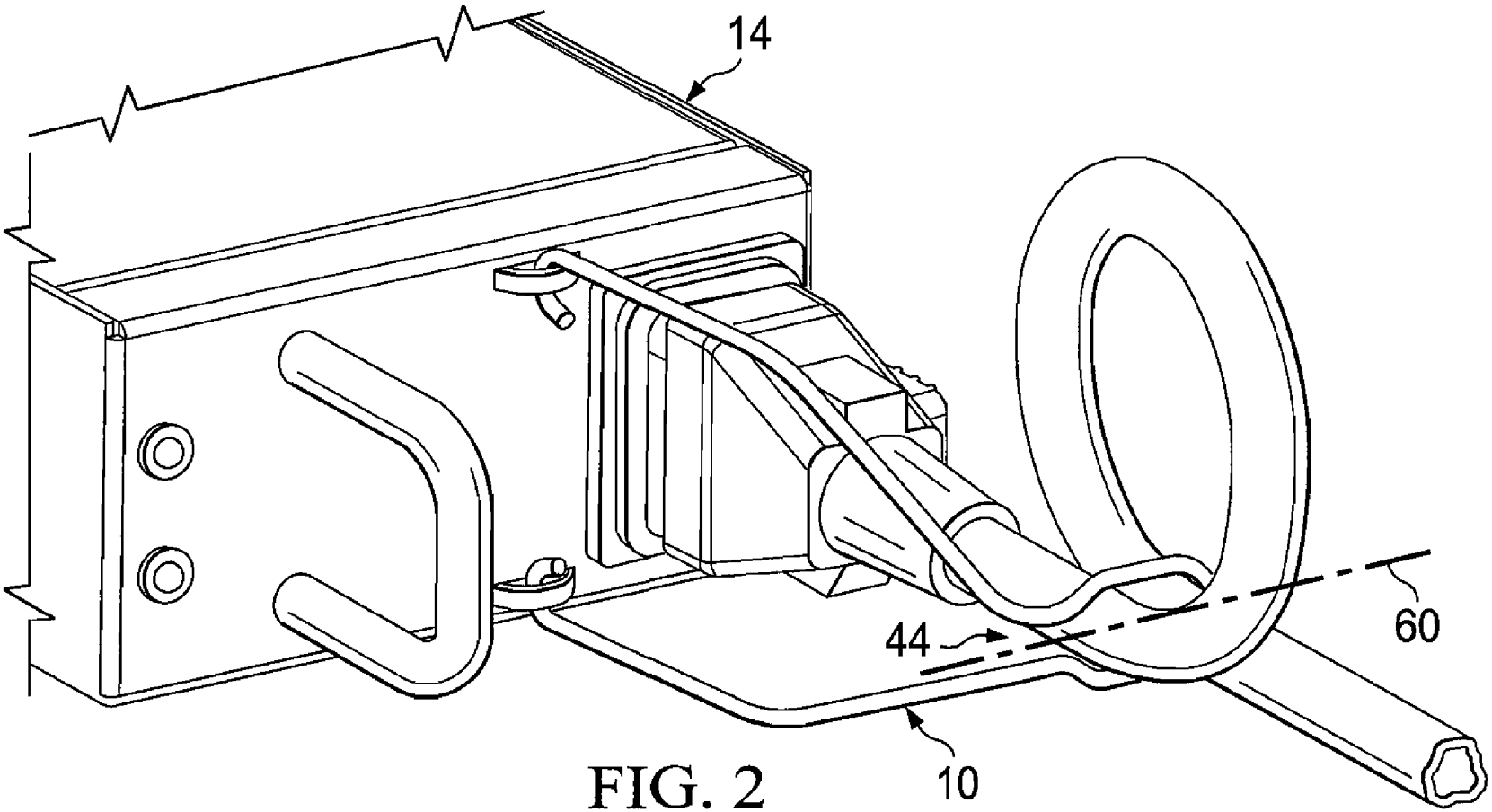
FIG. 2 is an example schematic diagram showing another configuration of the device of FIG. 1.

Body portion 22 also includes a tapered section 34 in one example configuration. Body portion 22 can be spaced from (and can be connected to) a securing portion 36 of device 10. Securing portion 36 has a passage 39 arranged to receive a portion 38 of cord 12 that is spaced from cord head 16. The passage extends along a passage axis 60, as seen in FIG. 2. When cord 12 is tensioned distally from cord head 16 (in the direction of arrow 11 for example), device 10 inhibits this retracting force from being transferred to cord 12 and through cord head 16 and, thus, prevents disconnection of cord head 16 from the socket assembly (or coupling) 18. Stated in different terms, the retracting force (otherwise present) is not transferred to the head, but rather to device 10. This prevents an accidental disruption of power for electronic component 14.

In this embodiment, cord 12 is looped around securing portion 36. Applying a pulling (or removal) force, especially if it is abrupt, may cause loop 40 to close around securing portion 36. The securing portion may mechanically interfere with the closed loop, by way of friction in this embodiment, to inhibit the pulling force being transferred to cord head 16. At the bottom of bent sections 24, some texturing can be applied to the surface to further inhibit this pulling force. The loop can be formed around securing portion 36 either when device 10 is attached to electronic component 14, or when it is not attached. In the case of the latter, device 10 is then attached to electronic component 14 by inserting hooks 30 through loops 32.

Securing portion 36 has an inner wall 42 that defines passage 39, which is C-shaped in this example. Inner wall 42 defines a resiliently deformable lateral opening 44 bounded by opposing edge surfaces 46. The entire space defined by members 26 (in this area of passage 39 and opening 44) may be generally referred to as a cavity in this Specification. Opening 44 can be arranged so that edge surfaces 46 can be biased apart from their rest position. This increases the size of the opening for the cord being inserted therethrough and into passageway 39. In this example, the space between edge surfaces 46 is smaller than a width of the cord 12, although it need not be.

Cord 12 can be pushed through opening 44 and, thereby, resiliently expand opening 44. Opening 44 can then resiliently close behind the cord to retain it. Cord 12 is then confined within inner wall 42. In operation, a plurality of lengths of the cord can be inserted into passageway 39. A partial closure of the opening can be achieved simply by allowing it to close on its own. Alternatively, device 10 may include hinges (or other security mechanism, which may be coupled to body portion 22) that allows opening of opening 44 and enables a subsequently closure.

In this embodiment, the confinement of the cord may provide for a better closing of loop 40 around securing portion 36, which can improve the device's operation. In this example implementation, depth 37 of passageway 39 is approximately twice the width of cord 12. This allows for the insertion of two sections of cord 38 and 48 therein. Two sections of the cord can be inserted for a loop to be formed. Note that the depth does not have to be precisely twice the cord width and could be a range of suitable depths. Securing portion 36 could form a right angle 50 with body portion 22. This permits body portion 22 to project away from back surface 20 of electronic component 14 in a somewhat perpendicular fashion. This could be parallel to cord 12, where the cord passes through the C-shaped portion of device 10 without unduly distorting or stressing cord 12.

In some examples, electronic component 14 may be designed or manufactured to include device 10. Device 10 can form part of electronic component 14 and be integrally formed with back surface 20. In other embodiments, device 10 is arranged to be attached to back surface 20 using mechanical fasteners such as screws, rivets, or other security mechanisms, instead of hooks. In other embodiments, electronic component 14 is snapped into recesses formed in back surface 20. In another embodiment, device 10 is not arranged to attach to back surface 20 of electronic component 14, but is arranged to attach somewhere else to electronic component 14 such as a side or a top surface 54. In other embodiments, device 10 may be attached to another type of electronic component 14 such as a server rack, or form part of a server rack in a position to engage a cord for powering a computing device in the rack.

Figure 3:
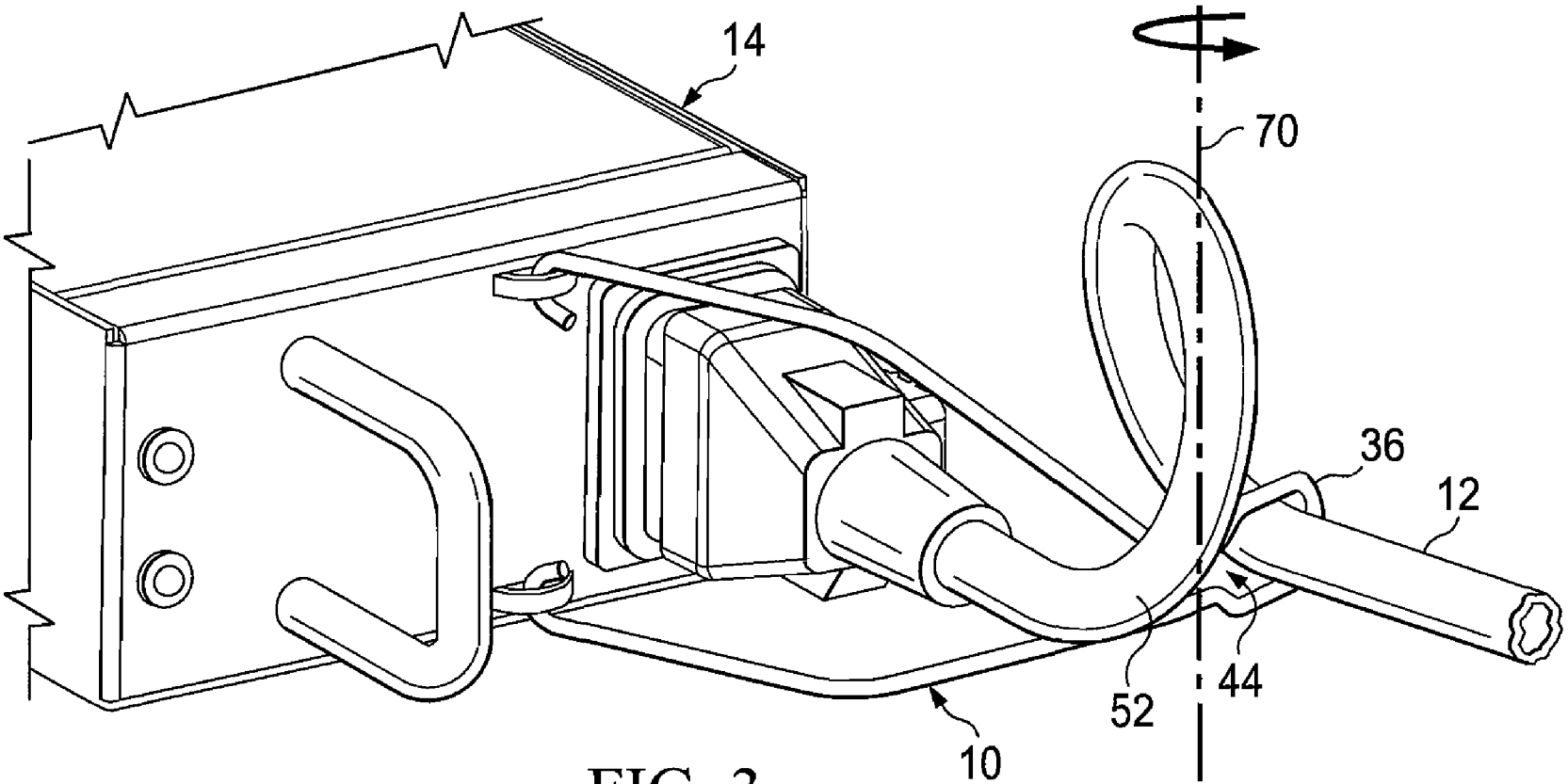
FIG. 3 is an example schematic diagram showing the device of FIG. 2 having a different cord configuration.

FIG. 2 is an example schematic diagram showing another configuration of device 10 of FIG. 1. In this example, device 10 has been rotated through 90 degrees relative to electronic component 14. Different angles of rotation may be suitable in some other embodiments. FIG. 3 is an example schematic diagram showing device 10 having a different cord configuration. FIG. 3 is similar to FIG. 2 but the cord is only partially engaged with securing portion 36. A section of cord 52 is yet to be pressed through opening 44 for confinement within securing portion 36. This FIGURE shows how the loop can be engaged to device 10. Cord 12 is forced through opening 44 and cord 12 is twisted around an axis 70 to form a loop, and then the cord is forced through the opening a second time. Again, the resistive force offered by device 10 is present in the event of an accidental pulling of cord 12 from its secure position.

Example embodiments of device 10 can achieve some advantages. For example, device 10 is resilient and forgiving in terms of the size of the cord, provided the bend radius of the cord is accommodating. Thus, a variety of cords having different diameters can be used with a single device. In addition, device 10 can be used with any corded electronic apparatus, where the cord is durable enough to handle the simple tension forces as discussed herein. Device 10 can be particularly applicable to power cords that rely on a simple friction fitting to a socket because only a small amount of retraction force can trigger an inadvertent disconnect. Additionally, device 10 can allow maintenance to be performed around (or on) electronic component 14 with less probability of an accidental disconnection of the cord. Also, device 10 can be used for a variety of different power cords having plugs of differing shapes and sizes, where little regard is given to the type of plug. The cord and plug can be connected to electronic component 14 without the need for tools, as the cord simply loops around the securing portion and the plug is inserted. The operation can be reversed for removing the plug without the use of any tools. This could allow, for example, the power cord to be readily accessed and disconnected in the event of an emergency. Additionally, the geometry of the cord or plug is not crucial to the operation of device 10. As a separate matter, the cord can remain stress free until the cord is accidentally pulled or tripped over. Device 10 also affords flexibility, as it can easily be moved aside or pivoted, giving access to the socket so the plug can be removed quickly.

It is imperative to note that all of the specifications and relationships outlined herein (e.g., width, length, diameter, etc.) have only been offered for purposes of example and teaching only. Each of these data may be varied considerably without departing from the spirit of the present invention, or the scope of the appended claims. The specifications apply only to one non-limiting example and, accordingly, should be construed as such.

It is important to note that the steps in the preceding FIGURES illustrate only some of the possible scenarios that may be executed by, or within, the presented architecture. Some of these steps may be deleted or removed where appropriate, or these steps may be modified or changed considerably without departing from the scope of the described concept. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided by the proffered system in that any suitable arrangements, chronologies, configurations, and timing mechanisms may be provided without departing from the teachings of the described concept.

Although the present invention has been described in detail with reference to particular embodiments, it should be understood that various other changes, substitutions, and alterations may be made hereto without departing from the spirit and scope of the present invention. The illustrated device and operations have only been offered for purposes of example and teaching. Suitable alternatives and substitutions are envisioned and contemplated by the present invention: such alternatives and substitutions being clearly within the broad scope of the proposed solutions. In addition, while the foregoing discussion has focused on electronic components associated with servers, any other suitable component prone to any type of incidental disconnection may benefit from the teachings provided herein. It should also be noted that the system described herein may be constructed of any suitable combination of rubber, plastic, metal, or any other viable composition that could withstand and readily accommodate the forces as explained herein.

Numerous other changes, substitutions, variations, alterations, and modifications may be ascertained to one skilled in the art and it is intended that the described concept encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this invention in any way that is not otherwise reflected in the appended claims.

What is claimed is:

1. An apparatus, comprising:

a body portion that includes a first member and a second member, wherein the members taper at one end and are configured to be coupled to an electronic component at another end; and a securing portion coupled to the body portion and configured to form a cavity through which a cord passes, the cord having a cord head that is fixed to the electronic component, wherein a portion of a force exerted on the cord is transferred to the securing portion such that detachment of the cord head from the electronic component is inhibited, and wherein the securing portion defines a space in the cavity such that a first instance of the cord and a second instance of the cord can both be positioned simultaneously in the cavity, and wherein the cavity is defined such that the first instance of the cord can rest on the second instance of the cord, which in turn rests on a bottom portion of the securing portion associated with the cavity such that the bottom portion of the securing portion supports weights of the first and second instances of the cord when in the cavity, wherein once the cord is looped through the cavity, a biasing force is exerted on the cord, and wherein the securing portion includes a texturing material on its surface that inhibits movement of the cord.

2. The apparatus of claim 1, wherein the body portion and the securing portion are integrally formed as a single wire.

3. The apparatus of claim 1, wherein the body portion includes one or more fastening elements for coupling to the electronic component.

4. The apparatus of claim 1, wherein the cavity is C-shaped and meets the body portion as the first and second members taper.

5. The apparatus of claim 1, wherein the body portion is coupled to the electronic component via hooks such that the hooks serve as an axis of pivot in order for the securing portion to move about the axis.

6. The apparatus of claim 1, wherein the body portion and the securing portion are constructed of steel or plastic.

7. The apparatus of claim 1, wherein the body portion is coupled to the electronic component via screws or rivets that secure the body portion to a back surface of the electronic component.

8. The apparatus of claim 1, wherein the body portion is coupled to the electronic component via screws or rivets that secure the body portion to a top surface of the electronic component.

9. The apparatus of claim 1, wherein the body portion is coupled to the electronic component via screws or rivets that secure the body portion to a side surface of the electronic component.

10. The apparatus of claim 1, wherein the cord head is retained in the cavity defined by the securing portion.

11. The apparatus of claim 1, wherein a loop of the cord and the cord head are held together in the cavity.

12. The apparatus of claim 11, wherein the loop and the cord head are received in the cavity, which includes a first recess for the cord and a second recess for the cord head.

13. The apparatus of claim 1, wherein a sleeve coupled to the cord head is retained in the cavity defined by the securing portion.

14. An apparatus, comprising:

a body portion that includes a first member and a second member, wherein the members taper at one end and are configured to be coupled to an electronic component at another end; and a securing portion coupled to the body portion and configured to form a cavity through which a cord passes, the cord having a cord head that is fixed to the electronic component, wherein a portion of a force exerted on the cord is transferred to the securing portion such that detachment of the cord head from the electronic component is inhibited, the body portion and the securing portion being integrally formed as a single wire, and wherein the securing portion defines a space in the cavity such that a first instance of the cord and a second instance of the cord can both be positioned simultaneously in the cavity, and wherein the cavity is defined such that the first instance of the cord can rest on the second instance of the cord, which in turn rests on a bottom portion of the securing portion associated with the cavity such that the bottom portion of the securing portion supports weights of the first and second instances of the cord when in the cavity, wherein once the cord is looped through the cavity, a biasing force is exerted on the cord, and wherein the securing portion includes a texturing material on its surface that inhibits movement of the cord.

15. The apparatus of claim 14, wherein the body portion includes one or more fastening elements for coupling to the electronic component.

16. The apparatus of claim 14, wherein the cavity is C-shaped and meets the body portion as the first and second members taper.

17. The apparatus of claim 14, wherein the body portion is coupled to the electronic component via hooks such that the hooks serve as an axis of pivot in order for the securing portion to move about the axis.

* * * * *